US007677190B2

(12) United States Patent
Miller

(10) Patent No.: US 7,677,190 B2
(45) Date of Patent: Mar. 16, 2010

(54) SLOTTED HULLS FOR BOATS

(76) Inventor: Buddie Gordon Miller, Timshel Lodge, Maracas Valley, St. Joseph (TT)

( * ) Notice: Subject to any disclaimer, the term of this patent is extended or adjusted under 35 U.S.C. 154(b) by 252 days.

(21) Appl. No.: 10/565,798

(22) PCT Filed: Jul. 26, 2004

(86) PCT No.: PCT/TT2004/000001

§ 371 (c)(1),
(2), (4) Date: Jan. 25, 2006

(87) PCT Pub. No.: WO2005/009833

PCT Pub. Date: Feb. 3, 2005

(65) Prior Publication Data

US 2008/0053355 A1 Mar. 6, 2008

Related U.S. Application Data

(60) Provisional application No. 60/490,925, filed on Jul. 30, 2003.

(51) Int. Cl.
*B63B 1/00* (2006.01)
*B63B 1/32* (2006.01)

(52) U.S. Cl. ..... 114/61.1; 114/288

(58) Field of Classification Search ..... 114/61.1, 114/67 A, 288–290

See application file for complete search history.

(56) References Cited

U.S. PATENT DOCUMENTS

| | | | | |
|---|---|---|---|---|
| 968,927 | A | 8/1910 | Frahm | |
| 1,759,511 | A * | 5/1930 | Kort | 440/38 |
| 3,076,426 | A * | 2/1963 | Alexander et al. | 440/46 |
| 3,291,088 | A * | 12/1966 | Klose | 114/39.25 |
| 3,514,962 | A * | 6/1970 | Poole | 405/170 |
| 3,929,644 | A * | 12/1975 | Fletcher | 210/242.3 |
| 4,993,349 | A * | 2/1991 | Solari | 114/289 |
| 5,438,947 | A * | 8/1995 | Tam | 114/312 |
| 6,250,240 | B1 * | 6/2001 | Thiger et al. | 114/61.12 |
| 6,250,246 | B1 * | 6/2001 | Hubley | 114/288 |
| 6,526,903 | B2 * | 3/2003 | Robinson et al. | 114/288 |
| 6,647,909 | B1 * | 11/2003 | Norek | 114/56.1 |
| 6,966,271 | B2 * | 11/2005 | Norek | 114/56.1 |

FOREIGN PATENT DOCUMENTS

GB 2 018 205 A 10/1979

OTHER PUBLICATIONS

Translation of the International Preliminary Report on Patentability of International Application No. PCT/TT2004/000001, with Form PCT/IB/373 and Form PCT/ISA/237.

* cited by examiner

*Primary Examiner*—Daniel V Venne
(74) *Attorney, Agent, or Firm*—Westerman, Hattori, Daniels & Adrian, LLP

(57) ABSTRACT

A boat hull providing substantially enhanced stability, safety and comfort over conventional boat hulls in common use, incorporating at least one relatively narrow, more-or-less vertical slot (23) running longitudinally and/or laterally through the hull of the boat and positioned so that the slot(s) (23) intersects a major portion of the depth of the water displaced by the boat hull. The slot(s) (23) may be fully or partially closed at any of its fore-end (31) or aft-end (33) or bottom-edge (25).

23 Claims, 5 Drawing Sheets

SLOTTED HULLS FOR BOATS

TECHNICAL FIELD

This invention relates to the hulls of boats and ships.

BACKGROUND ART

For the purposes of this Application the term "boat" shall be used and shall be construed to include all waterborne vessels including but not necessarily limited to: boats, ships, yachts, barges, canoes, kayaks, submarines, catamarans, trimarans, etc.

A common feature of traditional boats, is that they are based on the unit-body principle, that is, a hull-bottom with a single continuous skin, resting partially submerged at the surface of the water and displacing a single coherent body of water. Multihull boats (catamarans and trimarans) employ 2 or 3 respectively of such unit-body hulls, spaced apart from each other and held in juxtaposition by shared, rigid deck-beams. Submarines incorporate a completely continuous skin (monocoque) and operate either fully or partially submerged.

A major undesirable characteristic of boats is their predisposition to roll (side-to-side) and to pitch (fore-and-aft) under the influence of wind and/or waves and/or internal movement of weighty objects. This undesirable motion is exacerbated by the fabrication of tall and weighty superstructures, including: cabins, flying-bridges, masts, sails and rigging, to boat hulls. In severe or extreme situations, this predisposition has been the cause of countless loss of lives and boats. Many, varied devices have been, and continue to be employed in the effort to reduce the rolling/pitching actions, and to so produce a boat hull that is more stable and consequently more safe and more comfortable. Among these devices, may be listed:—

In-Hull Ballast: Heavy weights (stones/metal/water), stored inside the bottom of the boat hull. These bring the various penalties of: a) substantially increasing the weight (and displacement) of the boat; b) reducing the speed potential of the boat; c) increasing the power-requirement to propel the boat; d) increasing the mechanical stresses on the hull structure; e) very often requiring that this heavy ballast be moved from one side of the hull to the other, in order to compensate for the boat's changing aspect to the prevailing wind.

Ballasted Keels: Heavy weights (lead/steel/concrete) attached at some distance below the outer skin of the boat hull. These are more efficient than, but mainly present the same penalties as, the in-hull ballast described above. In both cases, a single Centre of Gravity (CG), set some vertical distance away from the virtual pivot established by a single Centre of Buoyancy (COB), acts to generate a pendulum-effect.

Powered Stabilizers: Generally lateral fins protruding from the underwater sides of a boat hull, with motions timed to somewhat counteract the rolling/pitching action of the boat. These bring the penalties of:—a) increased underwater drag on the hull; b) collision hazard with flotsam; c) significant power requirement for their operation; d) significant capital cost and maintenance requirement of complex machinery; e) weight addition to the boat; g) compromise in the watertight integrity of the hull because of their through-hull assembly.

"Flopper-Stoppers": Discs or planks of large surf area, hung horizontally below the water surface, on both sides of a boat hull and using their resistance to uplift through the water, to counteract the rolling action of the boat. These bring the penalties of: a) being useable only when the boat is at anchor; b) requiring active effort for their deployment/recovery at every anchor/off-anchor activity; c) requiring significant storage space whenever the boat is in-transit.

Increased Beam: Increasing the beam (width) of a boat hull generates an inherent increase in its lateral stability. This however brings the penalties of: a) decrease in streamlining and commensurate increase in drag (resistance) through the water and air; b) increased volume & weight & displacement for a given length of boat; c) much greater difficulty in recovery from a capsize situation.

Increased Floatation at Hull Ends: This is usually accomplished by one or more of the following devices:— i) Significant flaring (widening) of the bow sections of the hull.

ii) Keeping the bow and stern sections of the hull substantially empty or very lightly loaded.

iii) Bulbous-Bow: the fabrication of a substantial, elongated bulb protruding forward from the underwater section of the hull bow.

iv) Longitudinal centralization of a major weight components (engines, fuel tanks, water tanks) within the hull.

Singly or in combination, these devices present the penalties of: a) having principal effect mainly against the pitching and much less so against the rolling tendency of the boat; b) significantly increased water-resistance (drag) at the bow of the boat; c) sacrifice of otherwise useable interior space within the boat.

Multihulls: Conventional catamarans (2 hulls) and trimarans (3 hulls) do present the major advantage of significantly superior lateral stability versus monohulls of similar length. This benefit however, comes with the penalties of:—a) substantially increased beam (width) of the whole boat (typically one-half of the overall length of the boat); b) increased windage since the boat superstructure is so much more voluminous and more difficult to streamline; c) requiring almost double the docking-space as a monohull of similar length; d) unfavourable aesthetics to most boat-owners; e) significantly increased cost of manufacture; f) significantly increased mechanical stresses at the interconnecting points; g) sensitivity to weight-loading; h) sensitivity to wave-slap under the bridge(s) connecting the individual hulls; i) difficulty in road-trailering because of their substantial width; j) susceptibility to pitchpoling and to diagonal-capsize; l) extreme difficulty in recovering from a capsize situation.

What is pursued by all of the devices described above, is a boat hull of significantly enhanced, inherent stability, fore-and-aft as well as side-to-side. This desired hull should ideally incorporate and enabling device that is:—

Simple and un-complex in design & fabrication.

Inexpensive to manufacture.

Passive rather than active in operation.

Without most or all of the various penalties noted in the foregoing.

DISCLOSURE OF INVENTION

The disclosed invention sets out to improve the disposition of the bulls in boats, yachts and ships all of which may be propelled by a variety of means including, but not limited to, rowing, pedaling, sails, mechanical engines, electric motors, towing, etc. These vessels have one or more hulls, one or more of which rests partially submerged at the surface of the water. It is also applicable to submarine vessels which operate either fully or partially submerged. For the purposes of this disclosure, the term "boat" shall be constructed to included all and any of the above, and in any combination thereof.

The hull of a boat is generally designed to be laterally symmetrical and the weight-loadings of and in the boat are generally disposed so that the hull of the boat rests in balanced laterally symmetrical aspect on the water.

The submerged portion of the hull will generally be of roughly triangular or of inverted arctuate segment, in shape. In some instances the bottom of the hull may be essentially flat, yielding a rectangular submerged section, or may incorporate compound shapes.

In the majority of these instances, the hull will displace a body of water that is essentially symmetrical in lateral cross-section and thereby yields a Centre of Buoyancy (COB) that acts through the longitudinal centre-line of the hull. A consequence of this disposition of COB is that the boat has a tendency to rotate or see-saw (roll) about the virtual pivot-point of the COB. This tendency is exacerbated with increasing distance of separation of the Centre of Gravity (CG) of the boat, either above or below, from the COB.

The result of this interaction of forces is a hull that rolls (side-to-side) and/or pitches (front-to-back) under the influences of waves, wind and/or movement of people or other loads within the hull. Significant rolling or pitching of a boat directly reduce the stability of the boat, compromise its safe operation, and detract from the comfort and well-being of occupants.

Traditional methods for inhibiting the rolling/pitching actions of boats include:—

Extended keels under the hull: These bring the penalties of a) increased weight; b) increased wetted-surface/drag; c) increased structural demands on the hull; d) increased power-consumption; e) increased draft.

Weighty Ballast internal or eternal to the hull: This comes with the penalties of a) increased weight; b) increased wetted-surface/drag; c) increased structural demands on the hull; d) increased power-consumption; e) increased draft; f) increased articulating mechanisms—in the case of moveable ballast.

Stabilizing Sails: These require a mast and its associated rigging.

Multihulls—the rigid juxtaposition of additional hull(s) parallel to the primary hull: These introduce the penalties of a) substantially increasing the beam (width) of the boat with consequent limitations in docking space requirement; overland road transportability; accessibility to travel-lifts common at boat marinas. Multihulls also have the limitation of not being aesthetically favoured by the majority of boaters. A most significant limitation of multi-hulls is the extreme difficulty in righting once overturned and moreso if it is a sailboat with mast and sails attached.

Fixed and/or articulating stabilizer mechanisms: These generally include external appendages which are vulnerable to collision damage. They also introduce additional mechanical systems with attendant demands for installation, operation and maintenance. Included among these systems are gyroscopic-based mechanisms. It is clear that an elegant solution to the problems of rolling/pitching of boats would surmount or circumstep the limitations of the above-listed systems.

Accordingly, several objects and advantages of the disclosed invention are: to provide a boat hull which significantly reduces the rolling-action and/or the pitching-action to which traditional boat hulls are susceptible, and further:

a) to provide a boat hull of significantly enhanced inherent stability over traditional boat hulls;

b) to provide a boat hull that will be safer in use and operation than traditional boat hulls;

c) to provide a boat hull which will accord a significantly increased level of comfort and well-being to its occupants.

d) to provide a boat hull which retains favoured aesthetics while providing the substantial benefits of enhanced stability, enhanced safety and enhanced comfort.

e) to provide a boat hull with the enhancing benefits listed above, without the introduction of substantial additional weight to the hull.

f) to provide a boat hull with the enhancing benefits listed above, without significant increase to the power-requirements for propelling the hull.

g) to provide a boat hull with the enhancing benefits listed above, without any significant increase to the draft of the hull.

h) to provide a boat hull with the enhancing benefits listed above, without significant increase to the wetted-surface/drag of the hull.

i) to provide a boat hull which delivers the enhancing benefits listed above, for which benefits, the enabling structure enhances the inherent strength, stiffness and integrity of the basic hull.

j) to provide a boat hull which delivers the enhancing benefits listed above in entirely passive manner, without the introduction of any articulating mechanical or powered devices.

k) to provide a boat hull which delivers the enhancing benefits listed above, without requiring appendages external to the hull.

l) to provide a boat hull which delivers the enhancing benefits of listed above, without any requirement for alteration of the basic external dimensions of the boat/hull.

m) to provide a boat hull which delivers the enhancing benefits of listed above and which is adaptable to most, and possibly all, common hull configurations.

n) to provide a boat hull which delivers the enhancing benefits listed above and is easy and uncomplicated to manufacture.

o) to provide a boat hull which delivers the enhancing benefits listed above and which may readily be manufactured using any of the common boat-building materials p) to provide a boat hull which delivers the enhancing benefits listed above without substantial increase in construction cost; and possibly with reduced construction cost versus alternative systems of stabilization.

q) to provide a boat hull which delivers the enhancing benefits listed above and which would require no new skills or techniques for its operation and use; and which, by its reduction in user/operator fatigue, would enhance the comfort and well-being of its occupants.

r) to provide a boat hull which delivers the enhancing benefits listed above, and which would satisfy the requirements of the various regulatory/certifying agencies.

Still further objects and advantages will become apparent from a consideration of the ensuing description and drawings.

In summary the disclosed Slotted Hull invention engineers the vertical separation of the water displaced under a boat hull, into two or more effectively disparate bodies of water. Each separate body of water then generates its own Centre of Buoyancy (COB) acting under the hull at a designed distance from the COB of any other body of water.

This separation of Centres of Buoyancy establishes two or more "feet" for the hull to "stand" on in the water rather than the conventional situation of a unit-body hull balancing see-saw fashion on a single, central pivot-point.

This separation of COB's is achieved through the introduction of relatively narrow vertical slot(s) running through the hull of the boat at and below its waterline. The resulting "multi-footed" hull would be subject to significantly less rolling/pitching action; would be more stable on the water; would be safer in use and operation; and would enhance the comfort and well-being of its occupants.

This detailed description first considers that the hull of a typical boat presents a single Centre-of-Gravity (CG) to the supporting water, this CG conventionally falling somewhere along the longitudinal centre-line of the hull. The hull displaces a single coherent body of water which exerts an upthrust on the hull, his upthrust being effectively centered at its Centre of Buoyancy (COB). The COB acts at the CG of the body of displaced water which is not necessarily coincident with the CG of the boat either vertically or longitudinally.

Subject to the action of wind and/or waves and/or movement of loads within the boat, the single COB provides a single virtual pivot-point about which the hull of the boat tends to rotate in see-saw fashion. This rolling (side-to-side) and/or pitching (fore-and-aft) action: a) serves to limit the stability of the boat; b) limits the safe operation of the boat, and c) limits the comfort and well-being of the occupants of the boat.

It must be noted that rolling and/or pitching as described above are generally responses to dynamic stimuli, whereas stability may be seen as the tendency to resist rotational responses to shifting internal loads even in conditions of complete external calm.

The subject Slotted Hull invention alleviates the foregoing limitations by the introduction of vertical relatively narrow slot(s) running through the hull of a boat and intersecting the water-line of the hull in all situations of operation and/or loading.

The effect of these slot(s) is to vertically separate the body of water displaced by the hull into two or more effectively separate and distinct bodies, each body then exerting its own "body-of-buoyancy" and so its own COB to the hull.

Since the "effective" Centre of Gravity of a boat is not of itself a concentration of the actual weights distributed about the boat, a separation of the supporting water into different "bodies-of-buoyancy" would induce separation of the weight of the boat into different Centres-of-Gravity commensurate with the geometric footprints of the "bodies-of-buoyancy". This effective separation of COB's and of CG's would have the effect of providing the boat hull with a multiplicity of "feet" on which to stand in the water, rather than the conventional single pivot-point (COB) around which to rotate/see-saw.

In operation and use, it is not anticipated that the introduction of narrow slot(s) to a hull would result in any significant changes in the boat-handling and so no new skills or techniques in boat-operation would become necessary.

In the context that a more stable; more safe in operation; and more comfortable boat would substantially reduce operator and occupant fatigue and discomfort, a boat incorporating this Slotted Hull invention should provide for more comfortable, more confident and less stressful operation and use. It is evident then that the herein disclosed invention of the Slotted Hull provides several significant described, illustrated and anticipated advantages over conventional hulls in common use.

From the description and illustrations presented herein, a number of advantages of the Slotted Hull become evident:—

The Slotted Hull employs relatively narrow vertical slots, running along the length and/or across the width, and principally below the water-line of a boat hull, to separate the water displaced by the hull into two or more separate "bodies-of-buoyancy" each one generating its own Centre of Buoyancy (COB). These multiple created COB's act as multiple "feet" on which the boat hull stands in the water and which substantially inhibit the rolling and pitching actions to which conventional hulls are susceptible, and further:— a) provide a boat hull of significantly enhanced inherent stability over traditional boat hulls;
b) provide a boat hull that will be safer in use and operation than traditional boat hulls;
c) provide a boat hull which will accord a significantly increased level of comfort and well-being to its occupants.
d) provide a boat hull which retains favoured aesthetics while providing the substantial benefits of enhanced stability, enhanced safety and enhanced comfort.
e) provide a boat hull with the enhancing benefits listed above, without the introduction of substantial additional weight to the hull.
f) provide a boat hull with the enhancing benefits listed above, without significant increase to the power-requirements for propelling the hull.
g) provide a boat hull with the enhancing benefits listed above, without any significant increase to the draft of the hull.
h) provide a boat hull with the enhancing benefits listed above, without significant increase to the wetted-surface/drag of the hull.
i) provide a boat hull which delivers the enhancing benefits listed above, for which benefits, the enabling structure enhances the inherent strength, stiffness and integrity of the basic hull.
j) provide a boat hull which delivers the enhancing benefits listed above in entirely passive manner, without the introduction of any articulating mechanical or powered devices.
k) provide a boat hull which delivers the enhancing benefits listed above, without requiring appendages external to the hull.
l) provide a boat hull which delivers the enhancing benefits listed above, without any requirement for alteration of the basic external dimensions of the boat/hull.
m) provide a boat hull which delivers the enhancing benefits listed above and which is adaptable to most, and possibly all, common hull configurations.
n) to provide a boat hull which delivers the enhancing benefits listed above and is easy and uncomplicated to manufacture.
o) to provide a boat hull which delivers the enhancing benefits listed above and which may readily be manufactured using any of the common boat-building materials
p) to provide a boat hull which delivers the enhancing benefits listed above without substantial increase in construction cost; and possibly with reduced construction cost versus alternative systems of stabilization.
q) to provide a boat hull which delivers the enhancing benefits listed above and which would require no new skills or techniques for its operation and use; and which, by its reduction in user/operator fatigue, would enhance the comfort and well-being of its occupants.

r) to provide a boat hull which delivers the enhancing benefits listed above, and which would satisfy the requirements of the various regulatory/certifying agencies.

Accordingly the conclusions, ramifications and scope of this disclosure of the Slotted Hull of this invention present boat hulls which retain popular aesthetics and handling characteristics and further provide enhanced stability, safety and comfort.

The Slotted Hull incorporates relatively narrow, vertical slots running longitudinally and/or transversely through the hull of the boat. The slots are positioned principally below the water-line of the hull and their effect is to separate the supporting water into effectively separate and distinct "bodies-of-buoyancy" each of which would generate its own Centre of Buoyancy (COB). This multiplicity of COB's, each falling at some distance from any other generates a multiplicity of effective "feet" on which the hull 'stands' in the water, in contrast to the single COB of conventional hulls, the single COB being a single virtual pivot-point around/about which the hull tends to rotate/see-saw in rolling/pitching action.

The multiplicity of 'spread-apart feet' of the Slotted Hull of this invention would impart greatly enhanced stability, safety and comfort levels to the hull and commensurately enhance the operation and use experience. This is accomplished in a manner that is elegant in concept and design; simple, uncomplicated and inexpensive in manufacture; has minimal maintenance requirements; and is passive, straightforward and intuitive in operation and use.

Although the description above contains many specificities these should not be construed as limiting the scope of the invention but as merely providing illustrations of some of the presently preferred embodiments of this invention. For example, slots incorporated to boat hulls may:— incorporate contoured 'lips' wherever an edge of a slot interfaces with the water;

incorporate side-walls that are not perfectly vertical to the hull;

incorporate side-walls that are not perfectly parallel to each other;

incorporate side-walls that are not perfectly flat but may be corrugated or otherwise contoured;

incorporate top and bottom edges that are not perfectly horizontal to the hull;

incorporate top and bottom edges that are not perfectly parallel to each other;

incorporate thin-walled stiffener/reinforcing partitions vertically and/or horizontally within the slot(s)

be fitted with screens or solid closures to inhibit ingress to marine organisms;

be fitted with deflector appendages for the regulation and control of water-flow into, through, across or around the slot;

etc.

Thus the scope of the invention should be determined by the appended claims and their legal equivalents, rather than solely by the examples given.

BRIEF DESCRIPTION OF DRAWINGS

| DRAWINGS - Reference Numerals |
|---|
| 21 centre of buoyancy (COB) |
| 23 slot |
| 25 slot bottom edge |

-continued

Figure 1:
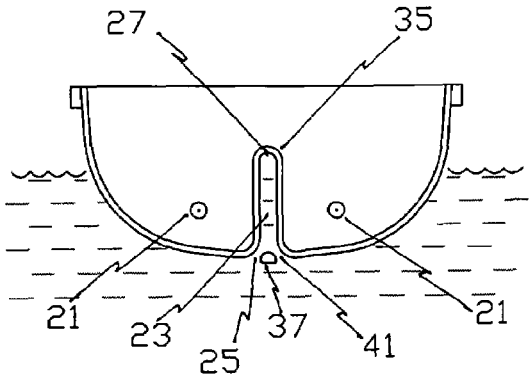

| DRAWINGS - Reference Numerals |
|---|
| 27 slot top edge |
| 28 fore-slope |
| 29 displaced water |
| 30 aft-slope |
| 31 slot fore-end |
| 32 fore bottom lip |
| 33 slot aft-end |
| 34 aft bottom-lip |
| 35 slot-trunk |
| 37 fixed-keel |
| 39 keel-strip |
| 41 keel-opening |
| 43 air-vent |

FIG. 1 illustrates a transverse section of a basic typical boat hull with a single vertical slot 23 running lengthwise along the centre-line of the hull. This slot 23 may be seen to separate the supporting water into two separate and distinct bodies of water, each separate body thus generating its own Centre of Buoyancy (COB) 21. As may be seen, the slot top edge 27 is closed along its length while the slot bottom edge 25 is open along at least part of its length.

It is clear that once there is some volume of free-air above the water-level within the slot 23 then there can be no upthrust from the water onto the boat-hull in the region of slot 23. There is therefore no Centre of Buoyancy 21 in that region. Consequently new and independent Centres of Buoyancy 21 are generated separately by each separate and distinct body of water displaced by the boat hull as illustrated in FIG. 2.

Figure 2:
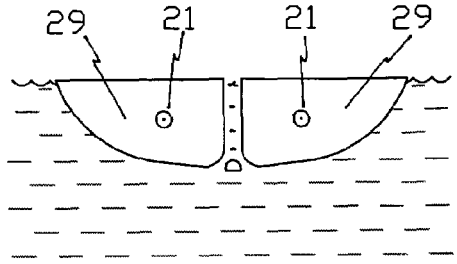

FIG. 2 illustrates a transverse section of the two separate bodies of displaced water 29 which are created by the slotted hull of FIG. 1. The two created COB's 21 may be seen to be laterally distanced from each other. This separation of the supporting water into two separate and distinct COB's 21 induces into the hull commensurate separation of the boat weight into two separate Centres of Gravity also laterally distanced from each other. The combined effect of these separations is to generate two virtual "feet" on which the hull "stands in the water". There is some similarity in this effect to the principle of the catamaran which employs two separate and distinct hulls to generate two separate and laterally distanced centres-of-buoyancy. The boat of this invention however generates a similar effect within the envelope of a single unit-body hull (i.e., a single hull unit).

Figure 3:
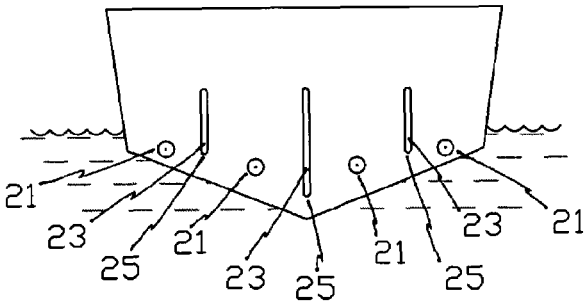

FIG. 3 shows a transverse section of a typical boat hull with a multiplicity of vertical slots 23 running along the length of the hull. Differing from the embodiment of FIG. 1, in this embodiment the slot bottom edges 25 are closed thus preserving the integrity of the outer plating of the hull and greatly enhancing the inherent strength of the hull structure. The slots 23 penetrate the hull plating only at the very slot fore-end 31 and at the very slot aft-end 33 (31 and 33 may be seen at FIG. 6).

Figure 4:
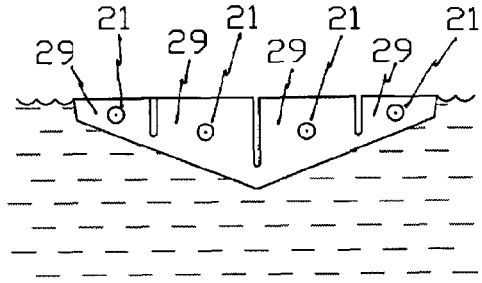

FIG. 4 shows a transverse section of the body of displaced water 29 generated by the hull of FIG. 3. Apparent here is the multiplicity of COB's 21 generated, spaced each from the other. The lateral stability imparted by this configuration may be likened to that of a basic log-raft.

Figure 5:
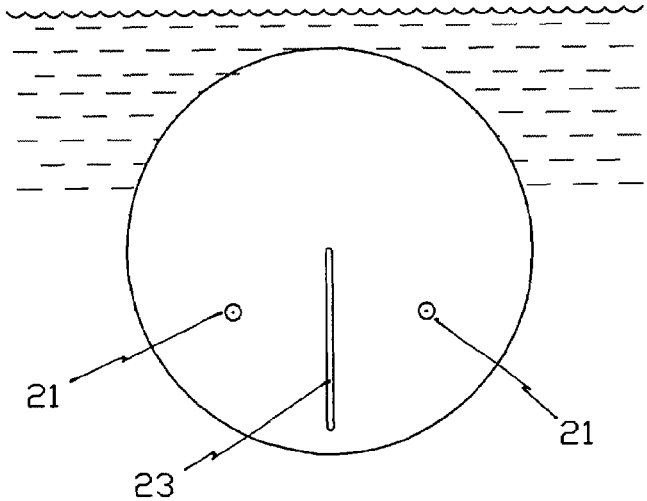

FIG. 5 shows a lateral section of a typical submarine vessel also incorporating a relatively narrow vertical slot 23 running lengthwise along its centre-line. In keeping with the principle of this invention, the slot 23 effectively separates the water displaced by the hull into two effectively separate bodies and so generates two separate and laterally distanced COB's 21.

These distanced COB's 21 replace the single, centrally positioned COB of conventional hulls around which the hull would tend to rotate. This results in a more laterally stable hull with less requirement for powered, dynamic stabilizers common to submarine vessels. Alternative embodiments of the slot placement illustrated in FIG. 5 could have the slot 23 centered vertically in the hull or positioned more in the upper half of the hull section.

Figure 6:
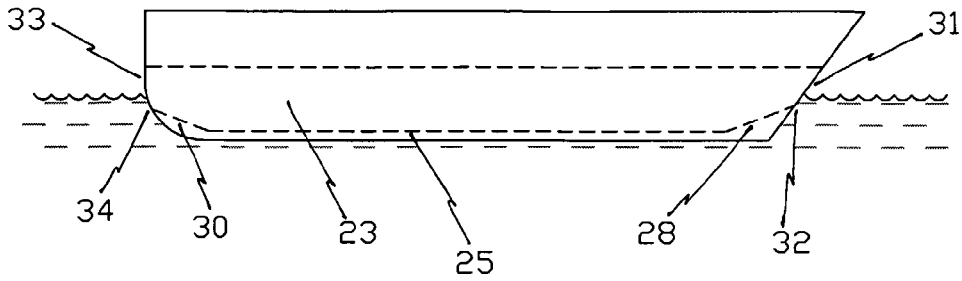

FIG. 6 shows a side view of a configuration of slot 23 wherein the slot bottom edge 25 is engineered to be as low as is practicable along the middle portion of the slot 23 in order to maximize the separation of the bodies of water displaced. The slot 23 however is fabricated with a fore-slope 28 approaching the slot fore-end 31, and with an aft-slope 30 approaching the slot aft-end 33. These sloped sections are intended to minimize the vertical height of the slot 23 at its fore-end 31 and aft-end 33 and by the reduction in size of these openings to the hull, so enhance the structural strength and integrity of the hull in these areas.

The bottom lips 32 and 34 of these reduced openings should be engineered to lie somewhat below the hull waterline in its least loaded (lightship) condition.

Figure 7:
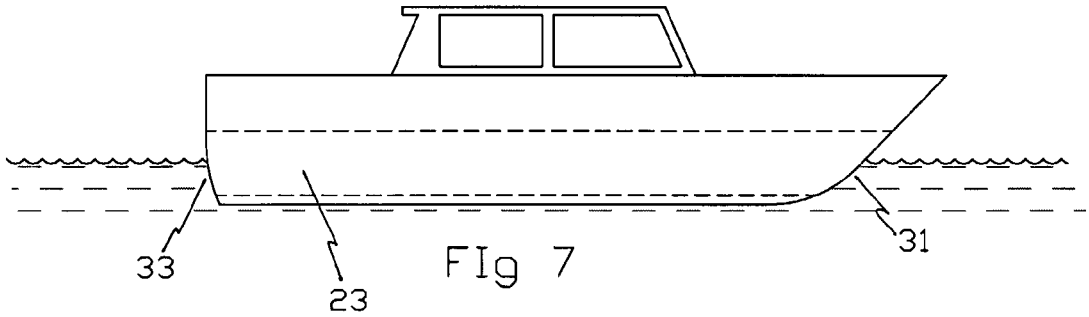

Illustrated in FIG. 7 is a side view of a typical boat with a single vertical slot 23 open at both its fore-end 31 and its aft-end 33.

Figure 8:
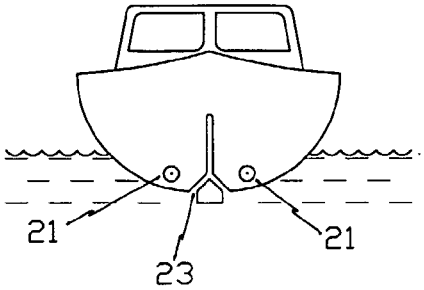

FIG. 8 shows a front view of the boat of FIG. 7 and illustrates the two COB's 21 generated by the slot 23.

Figure 9:
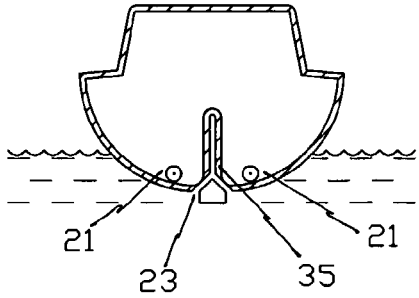

FIG. 9 shows a lateral section of the boat of FIG. 7 and illustrates the slot-trunk 35 which is fabricated to create the slot 23.

Figure 10:
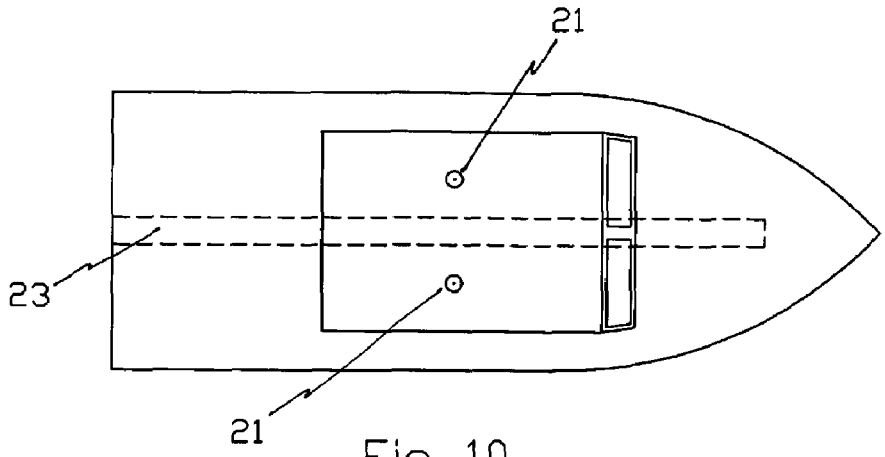

Illustrated at FIG. 10 is a plan view of the boat of FIG. 7.

Figure 11:
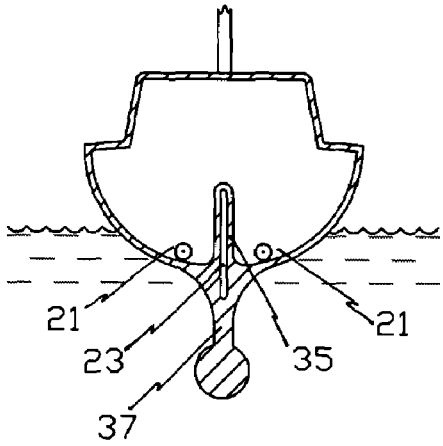

Illustrated in FIG. 11 is a transverse section of a typical sailboat with a fixed-keel 37. Shown is the vertical slot 23 extending some way vertically down through the fixed-keel 37. Also shown is the fabricated slot-trunk 35 which extends the slot 23 vertically upward to a point at or above the anticipated operating water-line of the hull.

Figure 12:
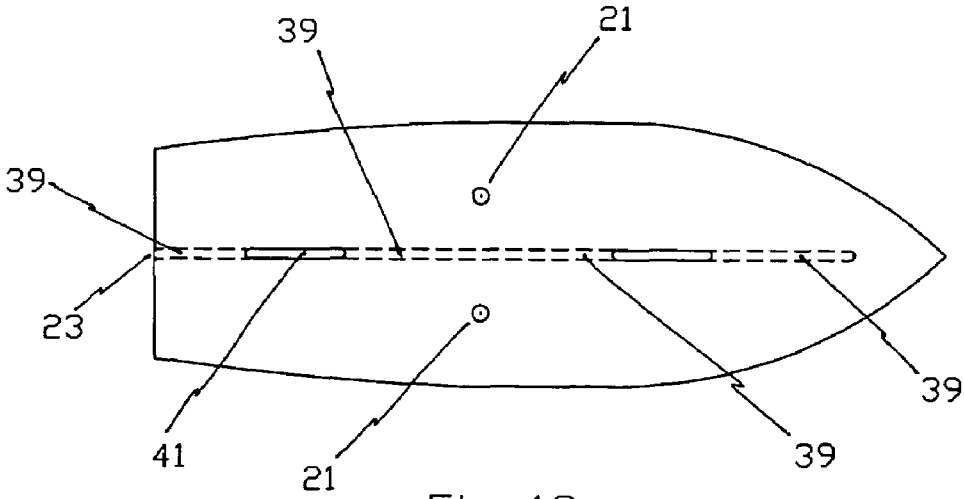

FIG. 12 shows an underside view of a typical boat hull with a single vertical slot 23 running along the centre of the hull. In this embodiment the bottom edge of the slot 23 is intermittently closed by keel-strips 39 alternating with keel-openings 41. This embodiment is intended to principally preserve the structural strength of the hull while at the same time permitting practical access to the interior of the slot 23 for the manual or mechanical cleaning of any marine growth accumulating therein.

Figure 13:
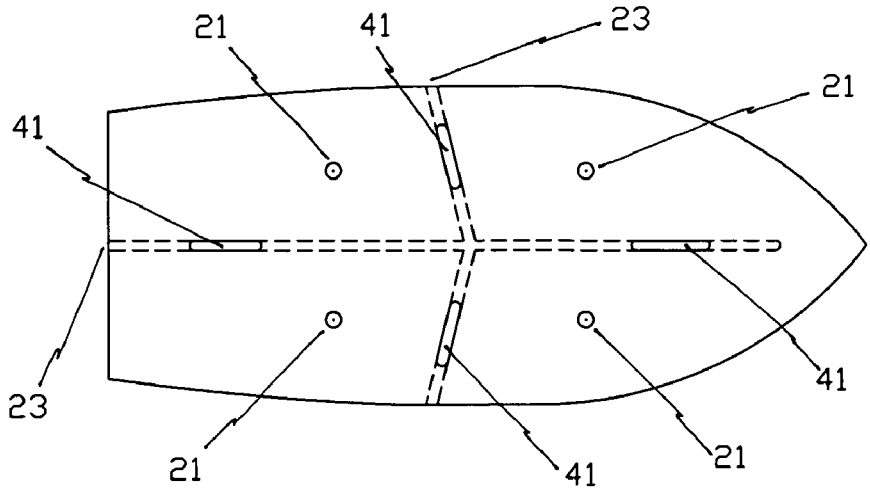

FIG. 13 shows an underside view of a typical boat hull incorporating both a longitudinal and an angled transverse slot 23. In this embodiment the supporting water would be separated into four different "bodies-of-buoyancy" each one generating its own COB 21. This four-legged stance would serve to inhibit both the rolling (side-to-side) and the pitching (fore-and-aft) actions of the hull.

Figure 14:
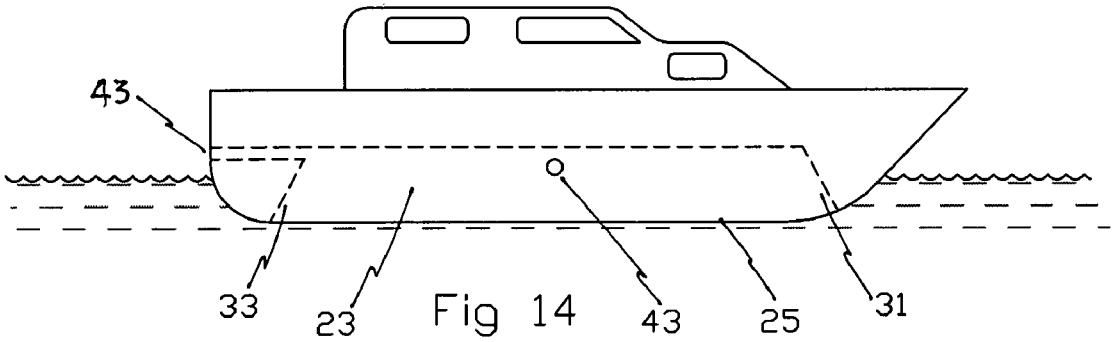

FIG. 14 shows a side-view of a typical boat having a vertical slot 23 running part-way only along the center-line of the hull. In this embodiment the slot 23 is closed at both its fore-end 31 and its aft-end 33, while being completely or intermittently open along its bottom edge 25. This embodiment preserves maximum structural strength and integrity at both ends of the hull while sacrificing some performance through the reduced length of the slot 23. Illustrated as well are the air vents 43 which are necessary to permit egress of air from the slot 23.

Figure 15:
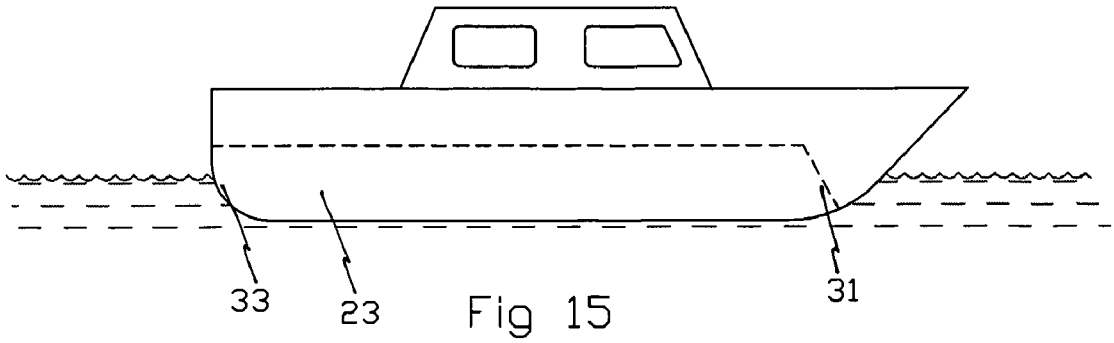

FIG. 15 shows an alternative embodiment of the partial-slot 23 of FIG. 14. In this embodiment the slot fore-end 31 remains closed while the slot aft-end 33 is open.

This embodiment maximizes the hull strength and integrity at its forward end where it is most vulnerable.

Figure 16:
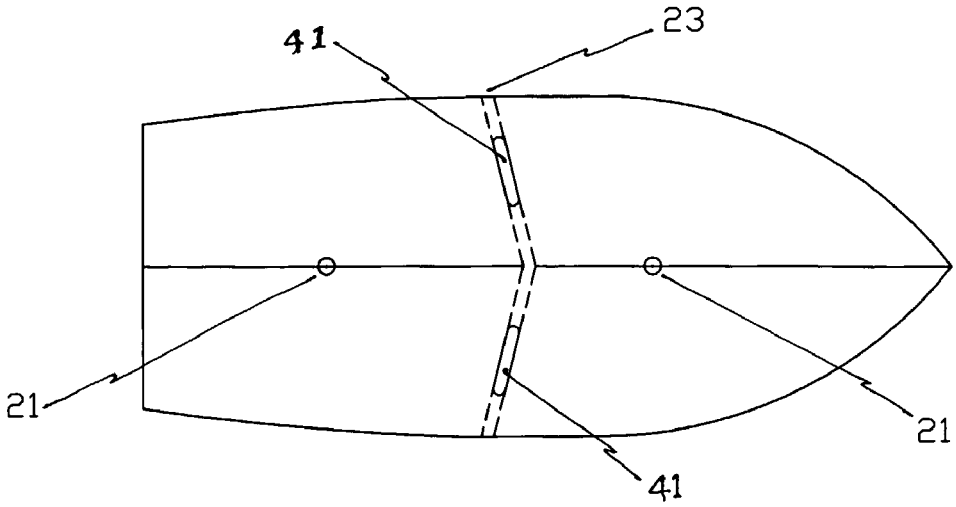

FIG. 16 shows an underside view of a typical boat hull incorporating a single, angled, transverse slot 23. The transverse slot 23 generates two COB's 21 longitudinally distanced from each other along the longitudinal centre-line of the hull. This transverse slot 23 would minimize the pitching (fore-and-aft) action of hull.

Figure 17:
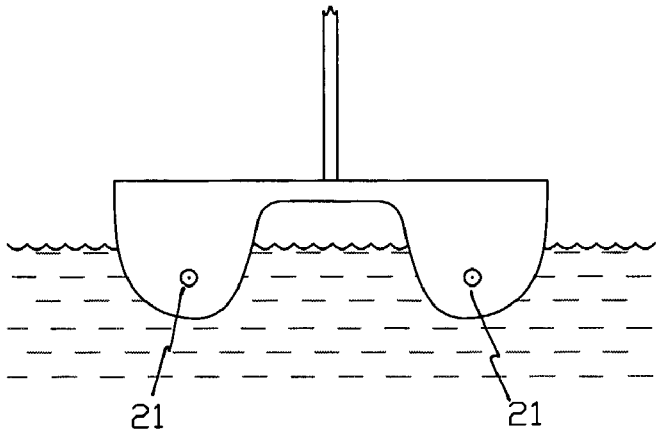

FIG. 17 illustrates a mid-section of a typical catamaran configuration. Because the catamaran already has two separate hulls and so, two separate and laterally distanced Centres of Buoyancy 21; also because the catamaran typically has relatively narrow hulls, longitudinal slots of this invention would have limited beneficial effect.

Figure 18:
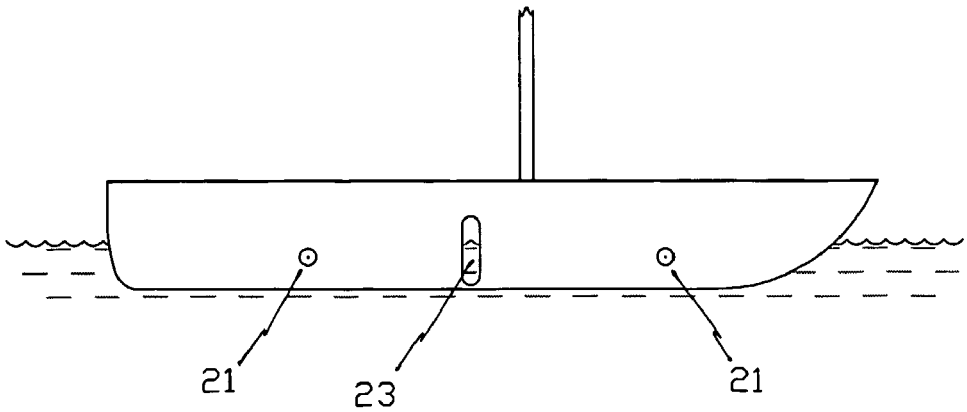

FIG. 18 illustrates a side-view of the catamaran of FIG. 17. Fore-and-aft pitching is a perennial problem of catamarans, leading to pitchpoling—end-over-end capsizing—and to diagonal-capsizing where one of the bow-ends becomes submerged and causes a capsize diagonally over that bow-end. The transverse slot 23 illustrated would generate separate and longitudinally distanced centres of Buoyancy 21 and so would substantially reduce the pitching tendency of these hulls.

BEST MODE FOR CARRYING OUT THE INVENTION

The straightforward simplicity of the functional element—a slot through-along or through-across, a boat hull—provides for utmost simplicity of construction as is illustrated in FIG. 1 of the drawings. Essentially all that is required is a fabricated or molded hollow trunk which would create and enclose the slot. This could quite easily be fabricated by a boat-builder of basic skill and using any of the common boat-building materials: wood/steel/aluminum/composites/etc, or a combination of any of these materials.

The slot would extend along most or all of the length of the hull and would extend vertically from the lowest practical level within the hull to a top level somewhat above the highest anticipated water-level about the hull.

The slot would require at least one aperture to its lowest extremity, such aperture(s) of sufficient open-area as to permit the easy ingress of water from beneath the hull.

The slot would further require at least one aperture venting to the open-air at its upper extremity, somewhat above the highest anticipated water-level about the hull. This aperture to be of sufficient open-area as to permit the easy egress of air that is displaced from within the slot.

A single aperture (or more that one) may be so fabricated as to combine the functions of water-ingress and air-egress, to and from the slot.

The engineering design demands are minimal as adding a rigid structural member to the inside of a hull would inherently enhance the stiffness and strength of the combined structure. At best the trunk could be fully integrated to the longitudinal and transverse structural framing members of the hull and so significantly enhance the structural stiffness and strength of the combined structure and so enable weight-savings in the fabrication of other components of the complete boat. This integration of the structural framework could also be used to advantage in designing in structural/watertight bulkheads; watertight compartments; flotation chambers; crash compartments; etc.

Among the specific considerations in design and manufacturing are:

A) Where transverse slots are employed, these slots should be fully or in most part closed along their undersides.

This is in recognition of the significant weakening of the hull structure, and of the significant disruption of streamlined water-flow, which would result from a substantially open-bottom transverse slot.

B) Creation of an open slot through the submerged portion of a boat hull would clearly result in some reduction in flotation (buoyancy) of the hull in the extent of the volume of the submerged portion of the slot. Given that the slot is designed to be relatively narrow, this loss of floatation volume should be of little significance when spread over the total volume of the submerged portion of the hull.

C) There is also the inconvenience of a slot-trunk which intrudes into the accommodation spaces of a boat. This would be an unavoidable cost of the substantial benefits to be derived from the invention and the boat-builder would need to design around this intrusion in the layout of the accommodation plan for the boat.

INDUSTRIAL APPLICABILITY

As made evident by the description and drawings of this disclosure, the fabrication of a slot(s) to boat-hulls of common design is entirely straightforward and well within the capabilities of both professional and amateur boat-builders.

Fabrication of the slot-trunk which creates and encloses the slot, may be effected in any of the common boat-building materials including, but not limited to, wood/steel/aluminum/encapsulated wood/composites/cored-composites; or in any combination of these materials. This fabrication is well within the competence of anyone with basic skills in boat-building.

Inherent in its design, the slot is entirely passive in operation with no moving nor articulated components. It is consequently as simple and uncomplicated in operation as it is in fabrication. Despite this simplicity, the slot does provide the significant and substantial benefits described within this disclosure.

I claim:

1. A boat having enhanced stability, safety and comfort, comprising:

a single hull unit having at least one elongated, substantially vertical slot extending substantially therethrough such that said slot divides said single hull unit into at least two substantially separate buoyant compartments, and such that water, on which the boat is floating, freely communicates with said slot and with air within and surrounding said slot;

wherein said slot is fully or partly open at at least a bow or a stern or a port side or a starboard side of said single hull unit;

wherein said slot is closed at its top;

wherein said single hull unit has a single bow portion substantially at a centerline of said single hull unit;

wherein said substantially vertical slot has a cross sectional area such that a vertical dimension of said cross sectional area of said slot is substantially greater than a horizontal dimension of said cross sectional area of said slot and wherein said single hull unit is a single, partly submerged hull of a mono hull vessel, or any single one of two individually partly submerged hulls of a catamaran, or any single one of multiple individually partly submerged hulls of a multi-hulled vessel.

2. The boat of claim 1, wherein said slot extends longitudinally through said single hull unit, wherein said slot runs through at least most of the length of said single hull unit.

3. The boat of claim 2, wherein said slot extends substantially along a longitudinal centerline of said single hull unit.

4. The boat of claim 1, wherein said slot is open on a bottom of said single hull unit.

5. The boat of claim 1, wherein said slot is closed on a bottom of said single hull unit.

6. The boat of claim 1, wherein an air vent is communicated with said slot.

7. The boat of claim 1, wherein said slot is intermittently open on its bottom.

8. The boat of claim 1, wherein said slot extends upwardly to a location above the waterline of said boat, such that said slot is simultaneously above and below said waterline.

9. The boat of claim 1, wherein said slot extends longitudinally or transversely through said single hull unit substantially along a longitudinal or transverse centerline thereof, and is fully or partly open on a stern, and on either a bow or a bottom of said single hull unit, and wherein said slot extends upwardly to a location above the waterline of said single hull unit such that said slot is simultaneously above and below said waterline.

10. The boat of claim 1, wherein multiple centers of buoyancy are created, at least one each on opposing sides of said slot.

11. The boat of claim 1, wherein said single hull unit includes a plurality of elongated slots extending longitudinally or transversely therethrough.

12. The boat of claim 11, wherein said single hull unit includes 3 elongated slots extending longitudinally therethrough, and wherein one of said 3 slots extends substantially along a centerline of said single hull unit.

13. The boat of claim 1, wherein said single hull unit is the hull unit of a submarine vessel.

14. The boat of claim 1, wherein the width of said slot is substantially constant along its length.

15. A boat having enhanced stability, safety and comfort, comprising:

a single hull unit having at least one elongated, substantially vertical slot extending substantially therethrough such that said slot divides said single hull unit into at least two substantially separate side-by-side buoyant compartments and such that water, on which said boat is floating, freely communicates with said slot and with air within and surrounding said slot;

wherein said slot is fully or partly open at a stern and closed at a bow of said single hull unit, or said slot is fully or partly closed at a stern and open at a bow of said single hull unit;

wherein said slot it closed at its top;

wherein said single hull unit has a single bow portion substantially at a centerline of said single hull unit;

wherein said substantially vertical slot has a cross sectional area such that a vertical dimension of said cross sectional area of said slot is substantially greater than a horizontal dimension of said cross sectional area of said slot and wherein said single hull unit is a single, partly submerged hull of a mono hull vessel, or any single one of two individually partly submerged hulls of a catamaran, or any single one of multiple individually partly submerged hulls of a multi-hulled vessel.

16. A boat having enhanced stability, safety and comfort, comprising:

a single hull unit having at least one elongated, substantially vertical slot extending approximately the length of said single hull unit such that said slot divides said single hull unit into at least two substantially separate side-by-side buoyant compartments, and such that water, on which the boat is floating, freely communicates with said slot and with air within and surrounding said slot; wherein said slot is closed at a bow and at a stern of said single hull unit;

wherein said single hull unit has a single bow portion substantially at a centerline of said single hull unit and wherein said substantially vertical slot has a cross sectional area such that a vertical dimension of said cross sectional area of said slot is substantially greater than a horizontal dimension of said cross sectional area of said slot.

17. A boat having enhanced stability, safety and comfort, comprising:

a single hull unit having at least one elongated, substantially vertical slot extending substantially there across such that the lengthwise dimension of said slot divides said single hull unit into at least two substantially separate fore-and-aft buoyant compartments, and such that water, on which said boat is floating, freely communicates with said slot and with air within and surrounding said slot;

wherein said slot extends transversely across at least most of the width of said single hull unit;

wherein said single hull unit has a single bow portion substantially at a centerline of said single hull unit;

wherein said slot is fully or partly open at least a port side or a starboard side of said single hull unit, or at a bottom of said slot;

wherein said transverse slot has its own intrinsic vertical, transverse and lengthwise dimensions such that the transverse slot extends in its own lengthwise dimension, along the transverse dimension of the boat hull and wherein said transverse slot has a cross sectional area such that a vertical dimension of said cross sectional area of said slot is substantially greater than a horizontal dimension of said cross sectional area of said transverse slot and wherein said single hull unit is a single, partly submerged hull of a mono hull vessel, or any single one of two individually partly submerged hulls of a catamaran, or any single one of multiple individually partly submerged hulls of a multi-hulled vessel.

18. The boat of claim 17, wherein said slot is angled.

19. The boat of claim 17, wherein said boat has two hull units and is a catamaran, and wherein one hull unit of said two hull units of the catamaran has a transverse slot extending substantially therethrough.

20. The boat of claim 17, wherein said boat has three hull units and is a trimaran, and wherein one hull unit of said three hull units of the trimaran has a transverse slot extending substantially therethrough.

21. The boat of claim 17, further comprising a second slot, wherein said second slot extends longitudinally through said single hull unit.

22. The boat of claim 17, wherein multiple centers of buoyancy are created, at least one each on opposing sides of said slot.

23. The boat of claim 17, wherein said slot extends transversely through said single hull unit, and is fully or partly open at a bottom of said slot and wherein said slot extends upwardly to a location above the waterline of said single hull unit such that said slot is simultaneously above and below said waterline.

* * * * *